United States Patent [19]

Skaggs

[11] 4,278,169

[45] Jul. 14, 1981

[54] PACKING DEVICE

[75] Inventor: Boyd T. Skaggs, Louisville, Ky.

[73] Assignee: Container Corporation of America, Chicago, Ill.

[21] Appl. No.: 73,672

[22] Filed: Sep. 10, 1979

[51] Int. Cl.[3] ..... B65D 85/02

[52] U.S. Cl. ..... 206/303; 206/418; 206/588; 206/592

[58] Field of Search ..... 229/1.5 R, 30, 39 B; 206/418, 521, 588, 592, 390, 303, 591, 593, 499, 516, 320; 219/42

[56] References Cited

U.S. PATENT DOCUMENTS

| | | | |
|---|---|---|---|
| 2,015,222 | 9/1935 | Hinson | 206/418 |
| 2,643,814 | 6/1953 | Bradley | 206/418 |
| 2,757,790 | 8/1956 | Gattuso | 206/521 |
| 3,215,331 | 11/1965 | Techman | 206/521 |
| 3,515,864 | 6/1970 | Levy et al. | 206/418 X |
| 3,900,156 | 8/1975 | Clark, Jr. | 206/521 |
| 3,910,409 | 10/1975 | Fortlage | 206/418 |

FOREIGN PATENT DOCUMENTS

| | | | |
|---|---|---|---|
| 505626 | 9/1951 | Belgium | 206/418 |
| 206764 | 11/1923 | United Kingdom | 229/39 B |
| 706393 | 2/1951 | United Kingdom | 229/39 B |
| 706470 | 3/1954 | United Kingdom | 229/39 B |

*Primary Examiner*—Joseph Man-Fu Moy

*Attorney, Agent, or Firm*—R. W. Carpenter; Davis Chin

[57] ABSTRACT

A packing device for isolating an article from walls of a shipping container is formed from a strip of paperboard, and has panel segments folded into position to isolate the article from the walls.

1 Claim, 7 Drawing Figures

PACKING DEVICE

BACKGROUND OF THE INVENTION

1. Field of the Invention

The structure disclosed herein relates generally to structures for isolating a packaged article from the walls of the container in which it is packed.

2. The Prior Art

Most of the prior art devices for such purpose make use of large blanks having dimensions corresponding to the inner transverse dimensions of the shipping container, the blank being apertured to receive the shipped article therethrough. A number of the so-apertured blanks are employed to isolate the article from the walls of the container. Such devices require the use of an inordinate amount of paperboard. Deeren, U.S. Pat. No. 3,235,065; LeBeau, U.S. Pat. No. 3,835,986 and Stuckert, U.S. Pat. No. Re. 25,605 are believed to be best examples of such devices.

SUMMARY OF THE INVENTION

The structure enables isolation of a shipped article of commerce from the walls of its shipping container with the use of a minimum of paperboard material. In a preferred embodiment of the invention, the device is formed from a cut and scored strip so folded as to embrace the article of shipment. The device is formed from a doubled strip so as to provide additional strength.

THE DRAWINGS

Figure 1:
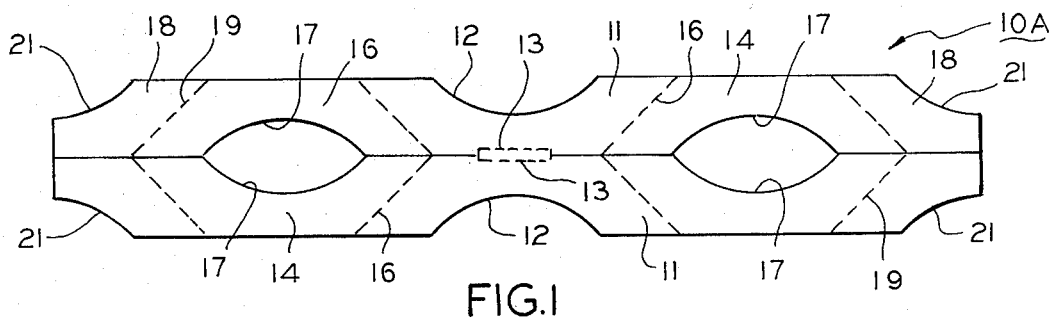
FIG. 1 is a plan view of a cut and scored strip of paperboard for forming a packing device according to the present invention.

The improved packing device is denoted generally by a reference numeral 10, and is shown in position within a walled shipping container SC positioned about a cylindrically shaped article of commerce C within the container SC.

The packing device 10 may be formed from a single blank having two side-by-side portions connected at central panel segments 11 thereof by a connector 13A foldable with respect to each segment 11 along parallel fold lines 13.

Each central panel segment 11 has an arcuate edge 12 corresponding to an arcuate contour in transverse cross-section of article C. The edge 12 contacts such contour. Each segment 11 has adjacent panel segments 14 foldably connected at each end of segment 11 along diagonal fold lines 16. Each segment 14 has an arcuate edge 17 corresponding to an arcuate contour of the article C adjacent to the arcuate contour of the article C in contact with the edge 12 of the segment 11.

Each of the adjacent segements 14 has a distal panel segment 18 foldably connected to the segment 14 along a diagonal fold line 19, and each segment 18 has an arcuate edge 21 corresponding to an arcuate contour of the article C which is not in contact with the arcuate edges 12 and 17.

Figure 2:
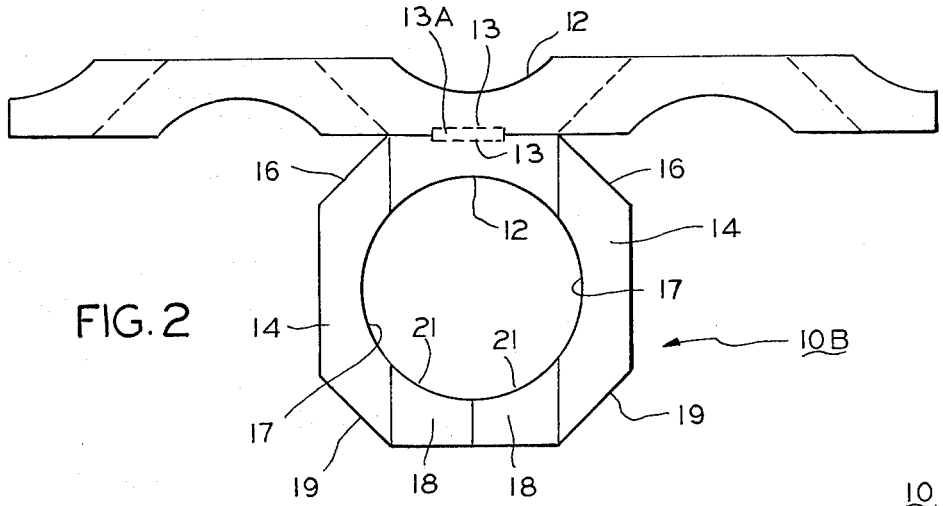
FIG. 2 is a plan view showing a step in the forming of the packing device.
Figure 3:
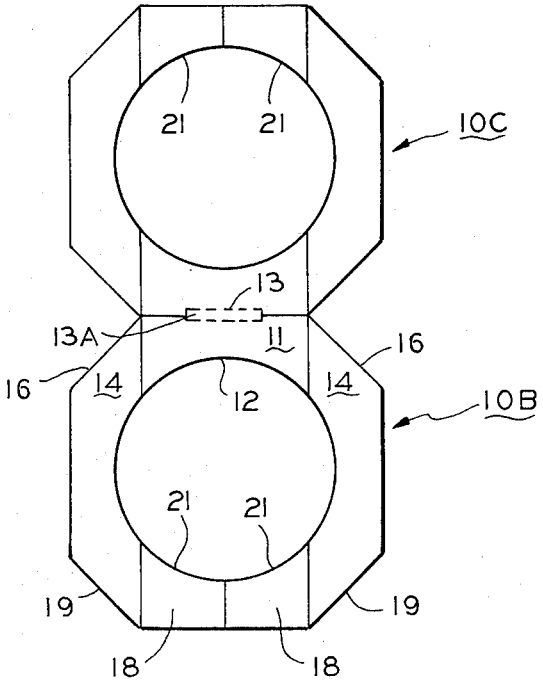
FIG. 3 shows another step thereof.
Figure 4:
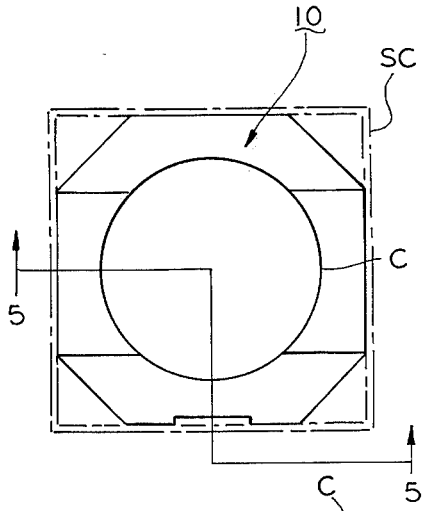
FIG. 4 is a plan view showing the device situated within a shipping container and isolating an article located therein from the walls of the container.

The packing device 10 is formed in steps as illustrated in FIGS. 2 and 3. One of the blank portions is formed into a shape 10B achieved by folding the adjacent panel segments 14 along the diagonal fold lines 16, and then by folding the distal panel segments 18 about the diagonal fold line 19.

Figure 5:
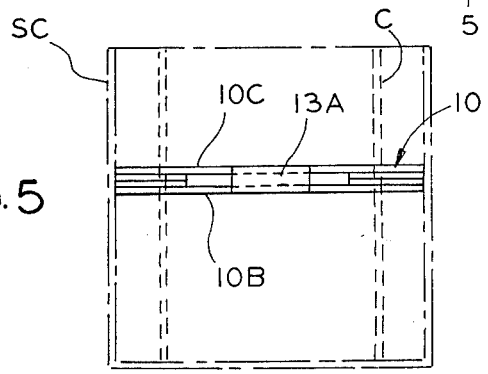
FIG. 5 is a sectional view taken generally along the line 5—5 of FIG. 4.

The same is done with the other blank portion to achieve a shape 10C which then can be folded over the shape 10B as seen in FIG. 5. The folded blank is then placed about the article C and within the container SC. It will be noted that the packing device 10 has its arcuate edges 12, 17 and 21 in contact with the arcuate contours of the article C, and that the perimeter edges of the device 10 are in contact with the interior of the walls of the container SC.

Figure 6:
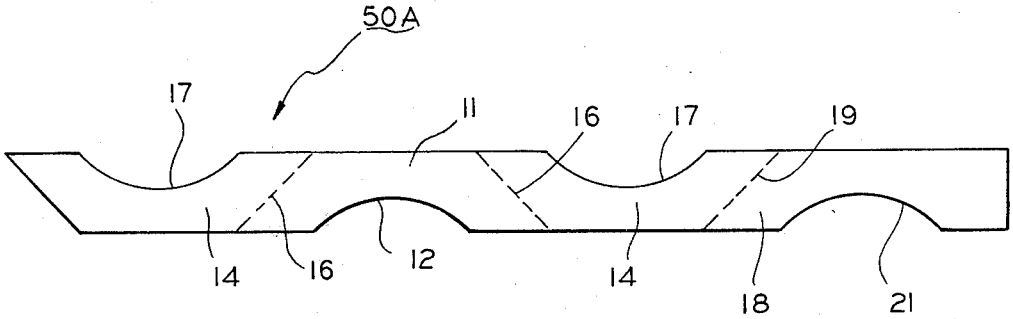
FIG. 6 is a plan view of a cut and scored strip for forming a packing device according to another embodiment.
Figure 7:
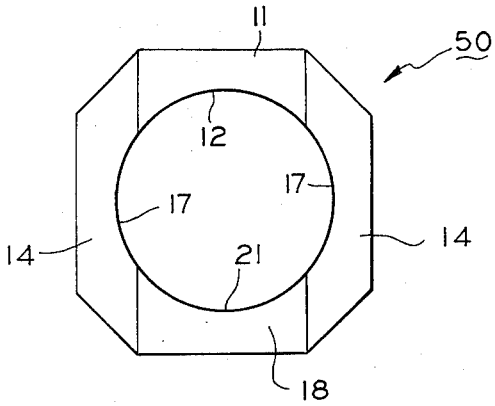
FIG. 7 shows the strip of FIG. 6 folded to form a packing device.

Referring now to FIGS. 6 and 7, there is shown another embodiment of the invention, designated 50 and formed from a blank 50A, where but one distal panel segment 18 is employed, it being of a dimension where it extends between the two adjacent panel segments 14 when folded into the position as seen in FIG. 7.

I claim:

1. A packing device of the character described for isolating an article having arcuate contours from the walls of a shipping container, said packing device being formed from an elongated strip of paperboard and comprising:

(a) a plurality of connected panel segments each having an arcuately contoured edge adapted to contact an arcuate surface of said article and an edge spaced from said contoured edge at a side of said panel segment remote from said contoured edge and adapted to contact a wall of said container in a plane normal to said wall;

(b) said connected panel segments having the arcuate contoured edge of one segment alternating with the wall contacting edge of an adjacent panel segment;

(c) said panel segments being connected along diagonal fold lines, so that upon folding of said segments at right angles to each other the arcuately contoured edges are in contact with the arcuate surface of said article, and the spaced edge of each segment is in contact with the wall of said container.

* * * * *